US008911213B2

(12) United States Patent
Brandl et al.

(10) Patent No.: US 8,911,213 B2
(45) Date of Patent: Dec. 16, 2014

(54) ROTOR BLADE FOR A GAS TURBINE

(75) Inventors: Herbert Brandl, Waldshut-Tiengen (DE); Sven Schofer, Basel (CH); Claus Paul Gerdes, Rütihof (CH); Hans-Peter Bossmann, Lauchringen (DE)

(73) Assignee: Alstom Technology Ltd, Baden (CH)

( * ) Notice: Subject to any disclaimer, the term of this patent is extended or adjusted under 35 U.S.C. 154(b) by 1176 days.

(21) Appl. No.: 12/637,280

(22) Filed: Dec. 14, 2009

(65) Prior Publication Data

US 2010/0150727 A1 Jun. 17, 2010

(30) Foreign Application Priority Data

Dec. 12, 2008 (CH) ..... 1957/08

(51) Int. Cl.
*F01D 5/14* (2006.01)

(52) U.S. Cl.
CPC ..... *F01D 5/147* (2013.01); *F05D 2260/36* (2013.01); *F05D 2240/30* (2013.01)
USPC ..... 416/223 A

(58) Field of Classification Search
USPC ..... 416/223 A, 225, 239, 223 R, 232, 233, 416/226, 227 R, 217, 219 R
See application file for complete search history.

(56) References Cited

U.S. PATENT DOCUMENTS 4,563,125 A * 1/1986 Boudigues et al. ..... 415/115
4,786,234 A * 11/1988 Readnour ..... 415/115
5,620,308 A * 4/1997 Yoshinari et al. ..... 416/241 R
2006/0120869 A1* 6/2006 Wilson et al. ..... 416/97 R
2008/0260538 A1* 10/2008 Wilson et al. ..... 416/97 R

FOREIGN PATENT DOCUMENTS

| | | |
|---|---|---|
| EP | 1905954 | 4/2008 |
| FR | 2463849 | 2/1981 |
| GB | 2027496 A | 2/1980 |
| JP | S6248903 A | 3/1987 |
| JP | H3-213601 A | 9/1991 |
| JP | 2008031985 A | 2/2008 |
| NL | 7905608 | 2/1980 |

OTHER PUBLICATIONS

Search Report for Swiss Patent App. No. 1957/2008 (Feb. 16, 2009).
Office Action (Translation of the Notification of Reasons for Refusal) issued on Sep. 24, 2013, by the Japanese Patent Office in corresponding Japanese Patent Application No. 2009-281859. (7 pages).

* cited by examiner

*Primary Examiner* — Edward Look
*Assistant Examiner* — Aaron R Eastman
(74) *Attorney, Agent, or Firm* — Buchanan Ingersoll & Rooney PC

(57) ABSTRACT

A rotor blade (10) for a gas turbine includes a blade airfoil (11), a blade tip (15), a blade root (14), and a platform (12) which is formed between the blade tip (15) and the blade root (14), and is assembled from a plurality of individual sections (16, 17, 18), the material of which is adapted in each case to the intended purpose of the individual section concerned. With such a rotor blade, a simplified production is achieved as a result of each of the individual sections (16, 17, 18) from the dimensions being significantly smaller than the assembled rotor blade (10).

10 Claims, 2 Drawing Sheets

ROTOR BLADE FOR A GAS TURBINE

This application claims priority under 35 U.S.C. §119 to Swiss application no. 01957/08, filed 12 Dec. 2008, the entirety of which is incorporated by reference herein.

BACKGROUND

1. Field of Endeavor

The present invention relates to the field of gas turbine technology, and to a rotor blade for a gas turbine.

2. Brief Description of the Related Art

Uncooled, hollow turbine rotor blades are customarily cast from one material. It is also known (U.S. Pat. No. 6,331,217), however, to join large rotor blades of a gas turbine, which are formed of a plurality of separately cast blade sections, by liquid phase bonding. In this case, either the blade airfoil is split in the longitudinal direction of the blade (FIG. 3 of U.S. Pat. No. 6,331,217), or the entire blade airfoil is produced separately from the platform and the blade root (FIG. 6 of U.S. Pat. No. 6,331,217). In the case of large blades, despite the division, this leads directly to large cast pieces having to be produced for the blade airfoil and interconnected in a form-fitting manner.

The same also applies to the rotor blade which is described in US-A1-2006/0120869, which inside the blade has a spar (12) which extends in the longitudinal direction and which in the region of the blade airfoil is enclosed on the outside by an aerodynamically effective shell (48). A similar concept, in which the outer shell is prestressed with a compressive stress, is known from U.S. Pat. No. 4,473,336. Finally, a comparable configuration, in which the outer shell of the blade airfoil is formed of a ceramic, is known from U.S. Pat. No. 4,563,128.

With the increase of efficiencies and effectiveness of modern gas turbine plants, the dimensions of the individual components, and consequently of the rotor blades, are also increased. As a result, considerable weight-related problems, inter alia, can occur in operation, and also manufacturing-engineering difficulties can occur when casting large components.

SUMMARY

One of numerous aspects of the present invention relates to a gas-turbine rotor blade which is optimized with regard to its weight without losing efficiency in the process.

Another aspect of the present invention concerns a blade which is assembled from a plurality of individual sections, the material of which is adapted in each case to the intended use of the individual section concerned, and that each of the individual sections from the dimensions is significantly smaller than the assembled rotor blade.

Another aspect relates to the idea of constructing a gas turbine rotor blade from a plurality of comparatively small individual sections of different materials, the material properties of which can be adapted to the respective local loads. On account of the thus possible variation of the materials, a significant optimization potential is available with regard to the net weight, the producibility, and production costs of the rotor blade.

Yet another aspect concerns constructing the gas turbine rotor blade from a plurality of individual sections in order to consequently be able to purposefully utilize material properties and to avoid possible size-related production problems. A clear function separation of the different sections is to be achieved. This, with the known and used materials, is associated with a relatively high density. This connection can be described by the so-called specific density. This is the relationship between material strength values and their density.

For this, materials can also be used which have a lower density. In all, smaller components can be produced more efficiently with regard to production engineering than a large component. As a result of the assembly of the blade from material-optimized individual sections, the following advantages can be achieved:

- Cost reduction
  - More flexible material selection by production of a plurality of individual sections
  - More efficient production (higher yield) by size reduction of the cast sections
- Optimized material selection
  - Corrosion-resistant shells (possibly from sheet material)
  - Tie rod with high specific strength
- Weight reduction by partial use of materials with low density
- The tie rod can fit deeper into the rotor body (>3 teeth on the blade root, or "long shank")

One development of a rotor blade according to principles of the present invention is characterized in that the individual sections are at least partially interconnected by a form-fit.

Another development of the blade is characterized in that the individual sections of the rotor blade include a lower blade section and an upper blade section which is connected to the lower blade section in the longitudinal direction of the blade, wherein the blade airfoil is split in the longitudinal direction of the blade into the lower and upper blade section, the lower blade section also includes the platform and at least a part of the blade root, and the upper blade section also includes the blade tip. As a result of such a split blade airfoil the dimension of the individual cast parts can be significantly reduced.

A further development is characterized in that, for absorbing the centrifugal forces which act upon the upper blade section, a tie rod, which extends in the longitudinal direction of the blade, is arranged inside the rotor blade, in that the tension rod with its upper end is in engagement with the lower end of the upper blade section, and in that the tension rod with its lower end directs the tension forces into the blade root. In particular, the tie rod has a foot section which forms a part of the blade root and with which the tension rod fits behind the lower blade section.

According to another development, an inwardly angled first angled element is arranged on the upper blade section, wherein the tie rod is in engagement with the upper blade section as a result of the tie rod fitting with a second angled element behind the first angled element.

The tie rod, however, can also include a plurality of tie rod sections which are arranged in parallel in the longitudinal direction of the blade, wherein the tie rod sections are spaced apart from each other transversely to the longitudinal direction of the blade, and wherein the spacing of the tie rod sections is fixed by subsequently insertable spacers.

BRIEF DESCRIPTION OF THE DRAWINGS

The invention is to be subsequently explained in more detail based on exemplary embodiments in conjunction with the drawing. In the drawing

DETAILED DESCRIPTION OF EXEMPLARY EMBODIMENTS

Figure 1:
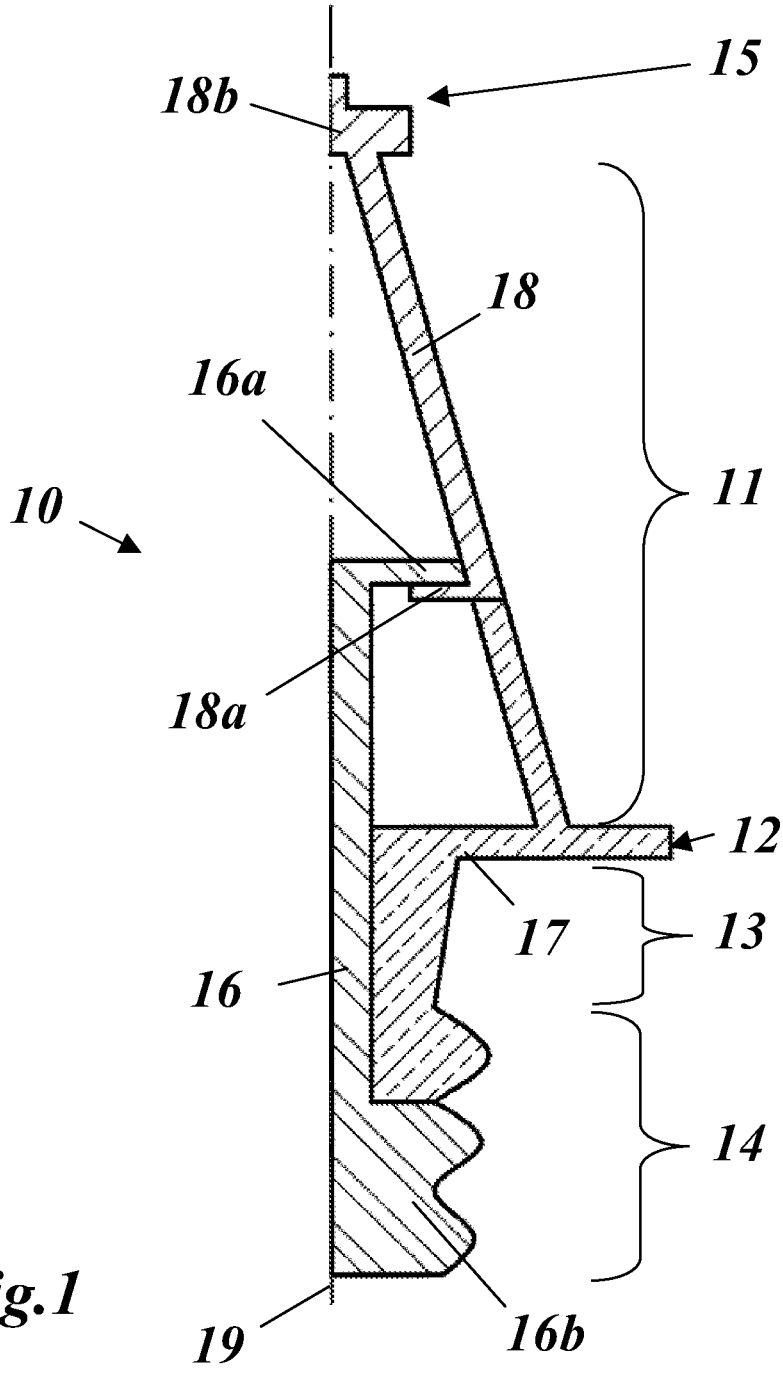
FIG. 1 shows a longitudinal section through a rotor blade according to an exemplary embodiment of the invention.

FIG. 1 shows a longitudinal section through a (constructed) rotor blade according to an exemplary embodiment of the invention. The rotor blade 10 of FIG. 1 includes three individual components, specifically an upper blade section 18, a lower blade section 17, and a tie rod 16. The rotor blade 10 has an aerodynamically effective blade airfoil 11 which extends in the longitudinal direction of the blade between a blade tip 15 and a platform 12. The blade airfoil 11 is split in the longitudinal direction into the upper blade section 18 and the lower blade section 17. A shroud segment 18*b* is formed at the upper end of the upper blade section 18. An inwardly projecting first angled element 18*a* is formed on the lower end of the upper blade section 18 and behind which the inner tie rod 16 fits with a second angled element 16*a* which is attached on its upper end and therefore retains the upper blade section 18 against the centrifugal forces which occur. The upper blade section 18 is therefore loaded only under tension.

The lower blade section 17 includes the lower section of the blade airfoil 11, the platform 12, a shank 13, and a part of a blade root 14 which, in the example which is shown, has a firtree-like edge profile (with 3 teeth). Another part of the blade root 14 is formed by a foot section 16*b* with which the tie rod 16 fits behind the lower blade section 17.

In the configuration which is shown in FIG. 1, the upper blade section 18 and the lower blade section 17 must have a significantly higher resistance to temperature and creep than the inner tie rod 16. The materials of the sections 17, 18 which are used on the one hand and the material of the section 16 which is used on the other hand can be correspondingly different. Within the blade height, the temperatures vary, however, so much that the use of differently adapted materials is also recommended for the two blade sections 17 and 18. Even the tie rod 16, as is indicated in FIG. 1 by the different hatching, can be formed of different materials in the longitudinal direction, when required. The tie rod, however, can also be produced continuously from one material.

The assembly of a rotor blade according to the invention can be carried out in different ways: if the tie rod 16 in the longitudinal direction is not split in a center plane 19, it can be inserted for example from the bottom into the blade interior, having been rotated by 90°, and then, by rotating back by 90°, can be brought into engagement with the angled element 18*a* at the upper end of the upper blade section 18.

Figure 2:
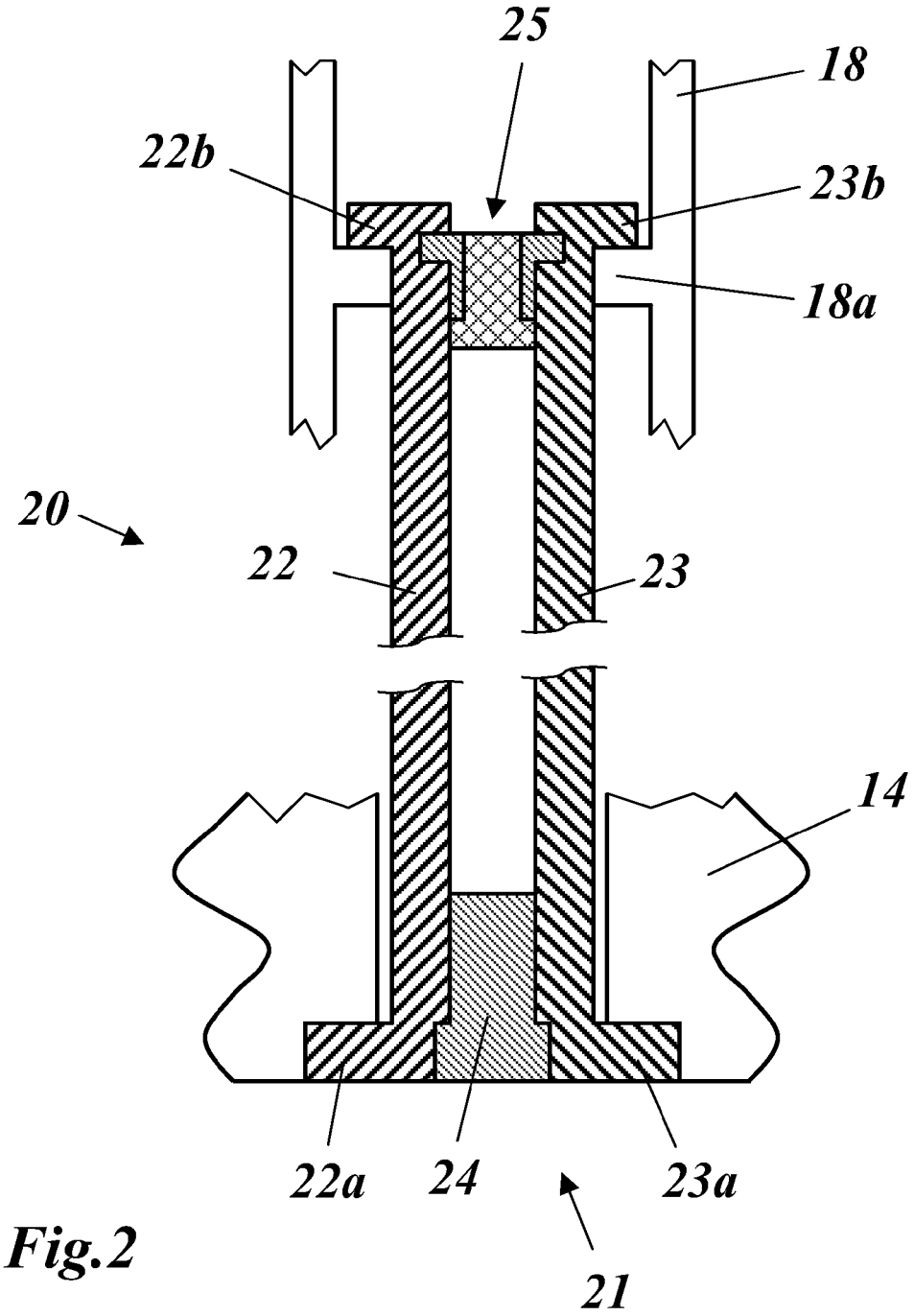
FIG. 2 shows the longitudinal section through a tie rod arrangement which is an alternative to FIG. 1.

It is also conceivable, however, in the case of a rotor blade 20 according to FIG. 2, to provide a tie rod 21 which is split in the longitudinal direction and includes two tie rod sections 22 and 23 which are formed minor-symmetrically to each other and which in the installed state are spaced apart from each other in the transverse direction and held apart by corresponding spacers 24 and 25. During the assembly of the rotor blade 20, the two tie rod sections 22, 23 are first inserted into the blade interior without spacers 24, 25 and without transverse spacing until the tie rod sections 22, 23 with their upper angled elements 22*b*, 23*b* can fit behind the angled element 18*a* of the blade airfoil. Then, the upper (round) spacer 25 is pushed upwards from the bottom between the two tie rod sections until it has reached the position which is shown in FIG. 2 and has fixed the two tie rod sections 22, 23 in the hooked-in position. Finally, at the lower end the lower spacer 24 is inserted between the tie rod sections 22, 23 so that these are supported with lower angled elements from the inside on a shoulder on the blade root 14.

LIST OF DESIGNATIONS

10, 20 Rotor blade (gas turbine)
11 Blade airfoil
12 Platform
13 Shank
14 Blade root
15 Blade tip
16, 21 Tie rod
16*a* Angled element
16*b* Foot section
17 Lower blade section
18 Upper blade section
18*a* Angled element
18*b* Shroud segment
19 Center plane
22, 23 Tie rod section
22*a*, 23*a* Angled element (lower)
22*b*, 23*b* Angled element (upper)
24, 25 Spacer While the invention has been described in detail with reference to exemplary embodiments thereof, it will be apparent to one skilled in the art that various changes can be made, and equivalents employed, without departing from the scope of the invention. The foregoing description of the preferred embodiments of the invention has been presented for purposes of illustration and description. It is not intended to be exhaustive or to limit the invention to the precise form disclosed, and modifications and variations are possible in light of the above teachings or may be acquired from practice of the invention. The embodiments were chosen and described in order to explain the principles of the invention and its practical application to enable one skilled in the art to utilize the invention in various embodiments as are suited to the particular use contemplated. It is intended that the scope of the invention be defined by the claims appended hereto, and their equivalents. The entirety of each of the aforementioned documents is incorporated by reference herein.

We claim:

1. Rotor blade for a gas turbine, which rotor blade comprises:

a blade airfoil, a blade tip, a blade root, and a platform which is formed between the blade tip and the blade root;

a plurality of individual sections together forming the rotor blade, the plurality of individual sections comprising an upper blade section, a lower blade section, and a tie rod, a material of each of which sections is adapted to the intended purpose of said individual section;

wherein the tie rod has an angled element on an upper end that is radially outward of and in engagement with an angled element on a lower end of the upper blade section; and wherein each of the plurality of individual sections in a longitudinal direction of the rotor blade is significantly smaller than an assembled rotor blade.

2. The rotor blade as claimed in claim 1, wherein the individual sections are at least partially interconnected by a form-fit.

3. The rotor blade as claimed in claim 1, wherein the upper blade section is connected to the lower blade section in the longitudinal direction, and wherein the blade airfoil is split into the lower blade section and the upper blade section.

4. The rotor blade as claimed in claim 3, wherein the lower blade section comprises the platform and at least a part of the blade root, and wherein the upper blade section comprises the blade tip.

5. The rotor blade as claimed in claim 3 wherein the tie rod is configured and arranged to absorb centrifugal forces which act upon the upper blade section, the tie rod extending longitudinally inside the rotor blade;

and wherein the tie rod has a lower end configured and arranged to transmit tension forces into the blade root.

6. The rotor blade as claimed in claim 5, wherein the tie rod comprises a foot section which forms a part of the blade root.

7. The rotor blade as claimed in claim 6, wherein the tie rod foot section is positioned below the lower blade section.

8. The rotor blade as claimed in claim 5, further comprising:

an inwardly angled first angled element arranged on the upper blade section;

a second angled element engaging the first angled element; and wherein the tie rod is attached to the second angled element.

9. The rotor blade as claimed in claim 5, wherein the tie rod comprises a plurality of tie rod sections which are arranged in parallel to the longitudinal direction of the rotor blade.

10. The rotor blade as claimed in claim 9, further comprising:

spacers; and wherein the tie rod sections are spaced apart from each other transversely to the longitudinal direction of the blade by the spacers.

* * * * *